US005328144A

United States Patent [19]

Donovan

[11] Patent Number: 5,328,144

[45] Date of Patent: Jul. 12, 1994

[54] TAMPER-PROOF TICKET HOLDER

[75] Inventor: Richard E. Donovan, Downington, Pa.

[73] Assignee: Donovan Associates Inc., Exton, Pa.

[21] Appl. No.: 8,653

[22] Filed: Jan. 25, 1993

[51] Int. Cl.[5] ..... A44B 11/25

[52] U.S. Cl. ..... 248/316.7; 24/67.3; 24/67.9

[58] Field of Search ..... 248/300, 316.7; 24/67 R, 67.3, 67.9, 67.11, 555

[56] References Cited

U.S. PATENT DOCUMENTS

| | | | |
|---|---|---|---|
| 1,439,138 | 12/1922 | White | 24/67.9 |
| 1,571,000 | 1/1926 | Eustis et al. . | |
| 2,873,082 | 2/1959 | Gillespie | 248/316.7 X |
| 3,057,028 | 10/1962 | Lorber | 24/67.9 |
| 3,237,326 | 3/1966 | Naffin | 24/67.3 X |
| 3,647,259 | 3/1972 | Hultquist . | |
| 4,011,673 | 3/1977 | Levine | 24/67.9 X |
| 4,706,342 | 11/1987 | Yu | 24/67.3 X |
| 5,010,629 | 4/1991 | Hirzel | 24/67 R X |
| 5,056,748 | 10/1991 | Meyer . | |
| 5,165,723 | 11/1992 | Evans | 24/67.9 X |

FOREIGN PATENT DOCUMENTS

| | | | |
|---|---|---|---|
| 281407 | 3/1952 | Switzerland | 24/67.9 |
| 360971 | 5/1962 | Switzerland | 24/67.9 |

*Primary Examiner*—David A. Scherbel
*Assistant Examiner*—Derek J. Berger
*Attorney, Agent, or Firm*—Herbert M. Wolfson

[57] ABSTRACT

Tamper-proof ticket holder comprising two opposing fingers, both having the width of a ticket, the distance between the fingers being sufficient to allow depression of the fingers for insertion of the ticket; the fingers being sufficiently flexible to hold the ticket securely.

3 Claims, 2 Drawing Sheets

TAMPER-PROOF TICKET HOLDER

FIELD OF THE INVENTION

The present invention relates generally to ticket holders for seats in commuter railway cars. More particularly, it relates to a ticket holder which will prevent tampering by its spring back nature, coupled with the fact that it will break if extreme deflection is attempted. The present holder presents a dangerous projection if it is distorted and can catch clothing, purse straps, or inflict injury to hands or arms.

BACKGROUND OF THE INVENTION

Passengers travelling on commuter transport vehicles, e.g., railways, rapid transits, street cars, busses, etc, are often provided with tickets which must be visually displayed for inspection or punching or collecting by the car conductor. It has been conventional to provide a ticket holder for displaying the ticket on the back of the seat in front of a given passenger.

Conventional ticket holders, as shown in FIG. 1, are clip-like devices comprising a strip of stainless steel riveted, or otherwise fastened, to the seat back. The ticket is wedged under a projecting finger to hold it in place.

Oftentimes, however, the clip is too tight to insert the ticket thereunder; and the passenger, in order to loosen the clip, may manually pry it outwardly. This may unduly deform or distort the clip so that the ticket cannot be tightly held and can easily drop onto the floor. The clip is also exposed to indiscriminate tampering by any occupant of the car. As a result, the clips are deformed or broken, often presenting a sharp projection to snag unsuspecting clothes or objects or injuring misplaced fingers.

Even without tampering, the open end of the prior art clip tends to catch on clothing, purse straps and the like. Sometimes, the open ends may inflict personal injury, especially when the clips have been vandalized and bend upward.

PRIOR ART

In U.S. Pat. No. 3,647,259, the inventor has provided a solution by placing a slotlike opening in the rear wall of the back rest of the seat. Located inside the back rest and aligned with the slotlike opening is a ticket engaging element. Being enclosed within the back rest, the ticket engaging element is protected from tampering. Guide means are also provided on either the rear wall of the backrest or on the engaging element itself to assist in directing the ticket, inserted through the slot, into a position where the ticket is engaged by the engaging element.

It is an object of this invention to provide a substantially tamper-proof ticket holder without the additional expense of modifying the back rest of all the seats in the railway car by placing slot-like openings in the rear walls of the back rests along with ticket-engaging elements and guide means to assist in directing tickets to the engaging elements. The main object of this invention is to merely replace the conventional but dangerous clip-like devices used currently as ticket holders with a novel tamper-proof safe ticket holder.

SUMMARY OF THE INVENTION

The present invention is a tamper-proof ticket holder located on the back of the seat in front of a given passenger, employing the identical mounting means as the stainless steel clip. The ticket holder comprises a body of substantially rectangular plastic material, usually flat, but may be contoured to fit the particular site where it is mounted on the back rest; a longitudinal, preferably substantially rectangular opening in the flat body, its width being approximately equal to the width of a ticket; two opposed fingers projecting from the two opposed transverse sides of the opening and disposed along the lengths of the opening, the space between the outer edges of the opposed fingers and the distance that the fingers project along the plane of the body of sheet material being substantially less than the thickness of the ticket to be inserted in the ticket holders; and means for mounting the ticket holders on the back of the seat.

The ticket is placed atop one finger, in flat configuration; the finger is then depressed and the ticket is slid under the opposing finger. Since the retaining fingers almost meet, it is impossible for the items to slip into the holder inadvertently.

Although metal, such as spring steel, or the like, can be used to manufacture the ticket holder of this invention, it is preferred to use a tough thermoplastic material. Though it is preferred to form the ticket holder by molding glass-filled nylon, high density polyethlene, polypropylene or polycarbonate, but it is also possible to use acrylic or cross-linked polymers. The thickness of the polymeric sheet material can easily be determined to provide the strength, toughness and flexibility that will yield a tamper-proof, safe ticket holder. It should be noted that with the appropriate material, the opposed edges of the retaining fingers can touch; and the ticket can be inserted by slightly forcing one flexible finger holder below the level of the other finger and inserting the ticket between the fingers.

Since the ticket holder of the invention is substantially tamper-proof and preferably composed of plastic, it is unlikely to become deformed or distorted. It is also less expensive than the prior art ticket holder to replace and maintain.

BRIEF DESCRIPTION OF THE DRAWING

Referring to FIG. 1, the prior art clip is composed of a stainless steel or other metal body 11 having a substantially rectangular opening, not shown. Projecting from body 11 at the end of the opening and disposed longitudinally over the opening is the clip or finger 13. The ticket 14 is inserted beneath the bottom surface of the finger 13 and over the top surface of the body 11.

The clip composed of body 11 and fingers 13 is mounted on the backrest 10 of the railway car by connectors passing through openings 12 in the clip body 11.

Figure 2:
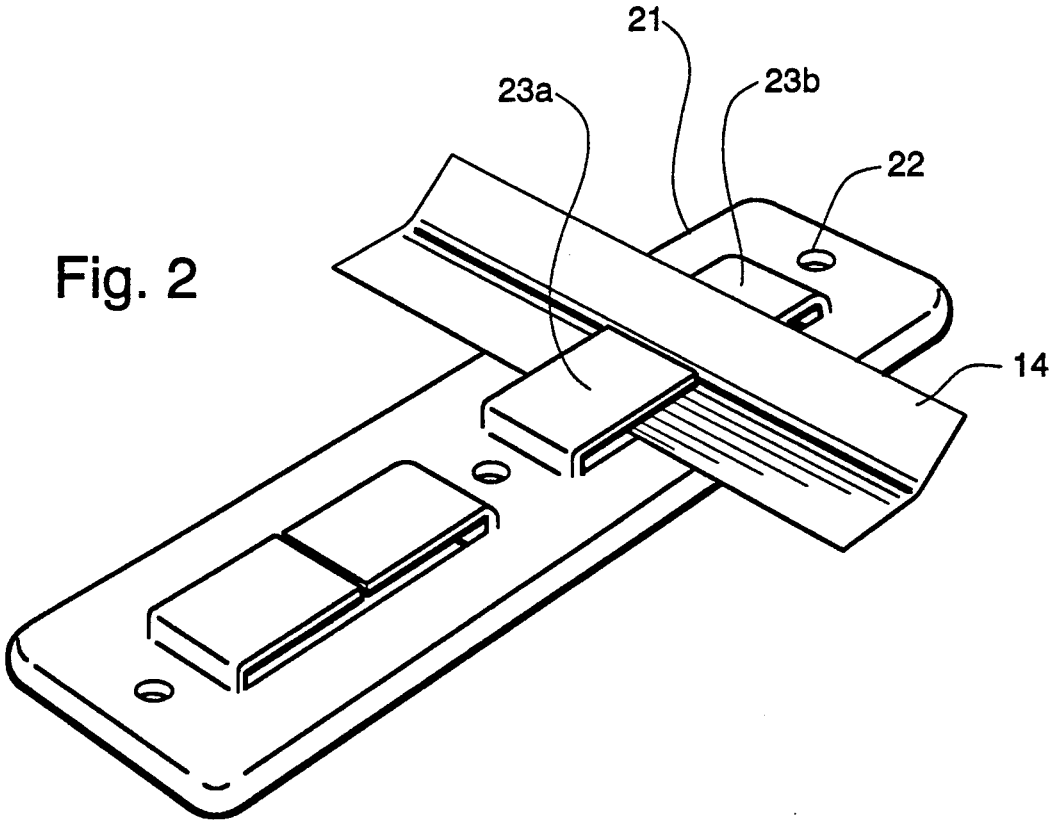
FIG. 2 is a view, in perspective, of the ticket holder of this invention.
Figure 3:
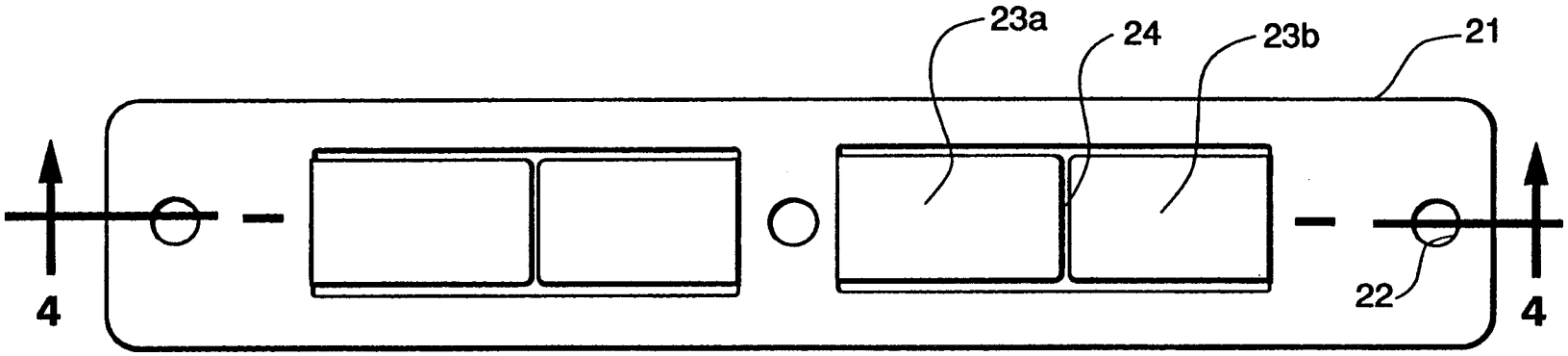
FIG. 3 is a top plan view of the ticket holder of this invention.
Figure 4:
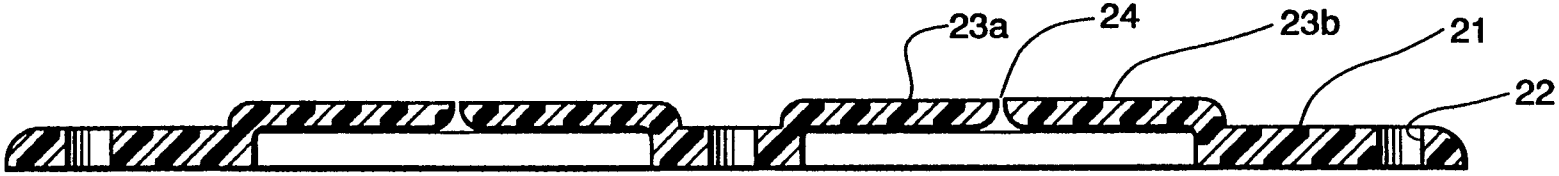
FIG. 4 is a vertical section taken along the line 4—4 of FIG. 3.

The ticket holder of the invention is shown in FIGS. 2, 3 and 4. It is composed of a body 21 of sheet material, preferably thermoplastic although metal can also be employed. There is at least one substantially rectangular opening 24 in body 21. Projecting from body 21 at the ends of the opening 24, either integrally molded with the body 21 or bonded thereto, are fingers 23*a* and 23*b*.

The fingers are disposed over the opening 24, their width being substantially equal to the width of opening 24. The length of the fingers are such that they touch, (or come within the width of a ticket of touching) at their extremities. It is preferable that the size of the fingers 23*a* and 23*b* are substantially equal, although it is not necessary for successful operation.

The ticket 14 is inserted between fingers 23*a* and 23*b* by depressing at least one of the flexible fingers and inserting ticket 14 so that a portion of its width is under one finger 23*a* and over the other finger 23*b* and held securely therebetween.

Figure 1:
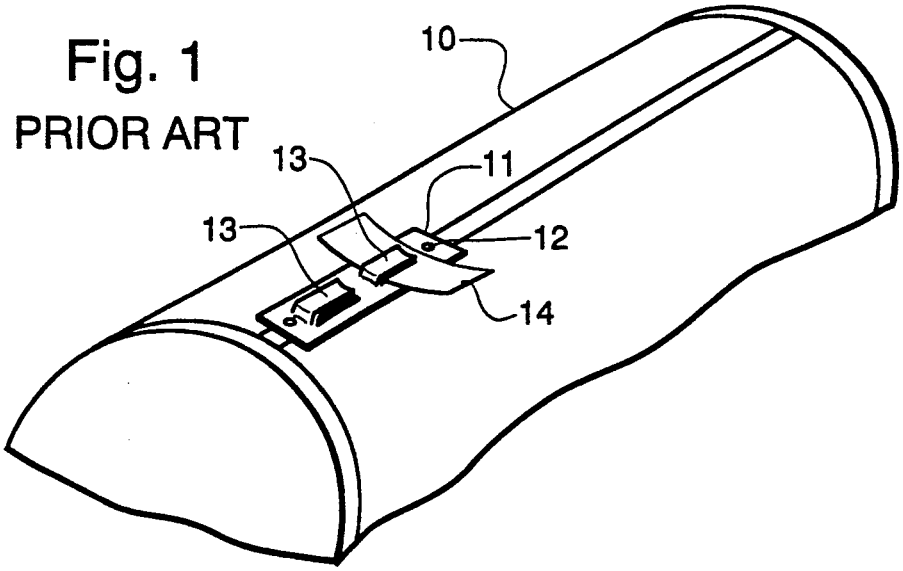
Fig. 1 PRIOR ART
FIG. 1 is a view, in perspective, of the prior art clip, mounted on the back rest of a railway seat.

The ticket holder of the invention may be mounted on the backrest 10 of the seat similar to the clip of the prior art as shown in FIG. 1, i.e., by connecting means adapted to fit through openings 22 in the body of 21.

While the invention has been illustrated and described in detail in the drawings and the foregoing description, no unnecessary limitations should be understood therefrom. All changes and modifications that are obvious to one skilled in the art come within the spirit and scope of the invention as represented by the claims that follow.

What is claimed:

1. A ticket holder comprising a flat body of sheet material having a substantially rectangular opening in said flat sheet; said opening having two opposed transverse sides at each end of its length; two opposed fingers projecting toward each other from the two opposed transverse sides of said opening, each finger terminating in an outer edge and disposed in a plane above the plane of said opening; the outer edges of said fingers being positioned so as to enable one to depress at least one of said fingers to admit said ticket and to hold said ticket tightly between the outer edges of said opposed fingers; and means for mounting said ticket holder on the back of a seat of a railway car.

2. A ticket holder as in claim 1 wherein said sheet material is (flexible) a substantially rigid, polymeric material but sufficiently flexible to enable one to depress at least one of said fingers.

3. A ticket holder as in claim 1 wherein the outer edges of said opposed fingers touch without preventing at least one finger from being depressed.

* * * * *